US009512608B2

(12) United States Patent
Al-Assfour

(10) Patent No.: US 9,512,608 B2
(45) Date of Patent: Dec. 6, 2016

(54) GROUND WATER COLLECTION SYSTEM

(71) Applicant: Faisal Abdul Aziz Al-Assfour, Hawally (KW)

(72) Inventor: Faisal Abdul Aziz Al-Assfour, Hawally (KW)

( * ) Notice: Subject to any disclaimer, the term of this patent is extended or adjusted under 35 U.S.C. 154(b) by 0 days.

(21) Appl. No.: 15/086,000

(22) Filed: Mar. 30, 2016

(65) Prior Publication Data

US 2016/0289947 A1 Oct. 6, 2016

Related U.S. Application Data

(60) Provisional application No. 62/140,422, filed on Mar. 30, 2015.

(51) Int. Cl.
*E03F 5/04* (2006.01)

(52) U.S. Cl.
CPC ..... *E03F 5/0404* (2013.01)

(58) Field of Classification Search
CPC ..... E03F 5/0401; E03F 5/0404; E03F 5/14
USPC ..... 210/163, 164, 170.03, 747.3; 404/4, 5
See application file for complete search history.

(56) References Cited

U.S. PATENT DOCUMENTS 4,419,232 A * 12/1983 Arntyr ..... E03F 5/14 210/164
5,405,539 A * 4/1995 Schneider ..... E03F 5/0404 210/163
5,632,889 A 5/1997 Tharp
6,270,663 B1 8/2001 Happel
7,112,274 B1 * 9/2006 Sanguinetti ..... E03F 5/0404 210/163
7,524,414 B1 4/2009 Barragan
2003/0127380 A1 7/2003 Morris et al.
2007/0199869 A1 * 8/2007 Al-Assfour ..... E03F 5/0404 210/164
2008/0023382 A1 1/2008 Longo et al.
2008/0290042 A1 * 11/2008 Hanson ..... E03F 5/0404 210/164
2009/0101553 A1 4/2009 Lucas
2011/0278237 A1 11/2011 McInnis
2013/0020242 A1 * 1/2013 Vreeland ..... E03F 5/0404 210/163

FOREIGN PATENT DOCUMENTS

WO WO 2008/099182 * 8/2008

* cited by examiner

*Primary Examiner* — Christopher Upton
(74) *Attorney, Agent, or Firm* — Richard C. Litman

(57) ABSTRACT

The ground water collection system is a filtering system for removing debris from ground water prior to drainage into a sewer line. The ground water collection system includes a basin having a drainage outlet formed through at least one sidewall. A filter shell is removably inserted within the basin, and a filter basket is removably inserted within the filter shell. A funnel member includes at least one funnel sidewall formed from mesh and opposed open upper and lower ends. An angled rim extends about the open upper end for funneling ground water through a central portion of the funnel member and into the filter basket. The funnel member is removably inserted within the filter basket so that the at least one funnel sidewall is positioned adjacent the open upper end of the filter basket. A grate removably covers an open upper end of the basin.

6 Claims, 5 Drawing Sheets

GROUND WATER COLLECTION SYSTEM

CROSS-REFERENCE TO RELATED APPLICATIONS

This application claims the benefit of U.S. Provisional Patent Application Ser. No. 62/140,422, filed on Mar. 30, 2015.

BACKGROUND OF THE INVENTION

1. Field of the Invention

The present invention relates to ground water drainage, and particularly to a ground water collection system for removing debris from ground water collected in a storm basin prior to delivery of the collected ground water to a sewage line.

2. Description of the Related Art

Storm basins for collecting ground water for delivery to a sewage system are well known. Such basins are typically buried below ground, and have an open upper end positioned adjacent or at ground level for receiving runoff. The open upper end is typically covered by a grate for preventing sticks and large debris from entering the basin. Unfortunately, smaller debris, such as dirt, sand, litter and the like, can easily pass through the grate and enter the sewer line. Accumulation of this smaller debris leads to clogs in the basin, which are not only costly and difficult to repair, but may also lead to flooding if the ground water cannot properly drain into the sewer line. Thus, a ground water collection system solving the aforementioned problems is desired.

SUMMARY OF THE INVENTION

The ground water collection system is a filtering system for removing debris from ground water prior to drainage into a sewer line. The ground water collection system includes a basin having at least one sidewall, a closed lower wall and an open upper end. A drainage outlet is formed through the at least one sidewall. The basin is formed from concrete or the like and is buried below ground. The open upper end of the basin is adjacent or at ground level for receiving the ground water. The drainage outlet is adapted for communication with the sewer line. A filter shell is removably disposed in the basin, and includes at least one mesh sidewall, a solid lower wall and an open upper end. Preferably, a plurality of legs extend from the solid lower wall of the filter shell for positioning the solid lower wall above the closed lower wall of the basin in spaced relation therewith, the solid lower wall of the filter shell being positioned adjacent the drainage outlet. A filter basket is removably inserted within the filter shell, and includes at least one basket sidewall, a basket lower wall and an open upper end. The at least one basket sidewall and the basket lower wall are each formed from mesh.

A funnel member is further provided and includes at least one funnel sidewall formed from mesh and opposed open upper and lower ends. An angled rim is formed about the open upper end for funneling the ground water through a central portion of the funnel member and into the filter basket. The funnel member is removably inserted within the filter basket such that the at least one funnel sidewall is positioned adjacent the open upper end of the filter basket and the angled rim is positioned adjacent the open upper end of the basin. A grate removably covers the open upper end of the basin.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
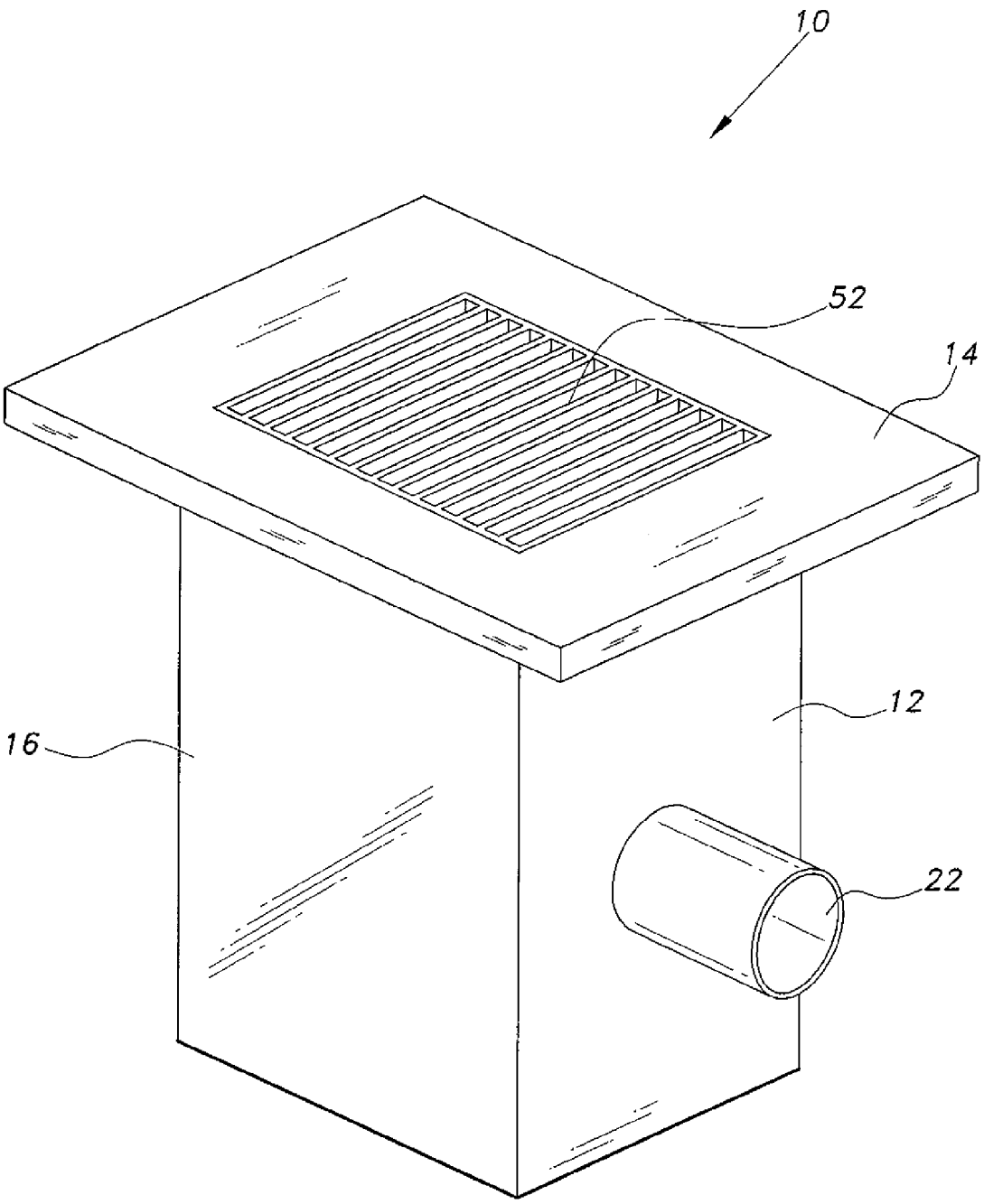
FIG. 1 is a perspective view of a ground water collection system according to the present invention.

The ground water collection system 10 is a filtering system for removing debris from ground water prior to drainage into a sewer line. A shown in FIGS. 1-3, the ground water collection system 10 includes a basin 12 having at least one sidewall 16, a closed lower wall 18 and an open upper end 20. A drainage outlet 22 is formed through the at least one sidewall 16, and a rim 14 is preferably formed about the open upper end 20. Although shown as being substantially rectangular and having four such sidewalls 16, it should be understood that the overall dimensions and configuration of the basin 12 may be varied. The basin 12 is formed from water impermeable materials, such as concrete or the like, and is buried below ground with the rim 14 surrounding the open upper end 20 being positioned adjacent or at ground level for receiving the ground water. The drainage outlet 22 is adapted for communication with the sewer line.

Figure 2:
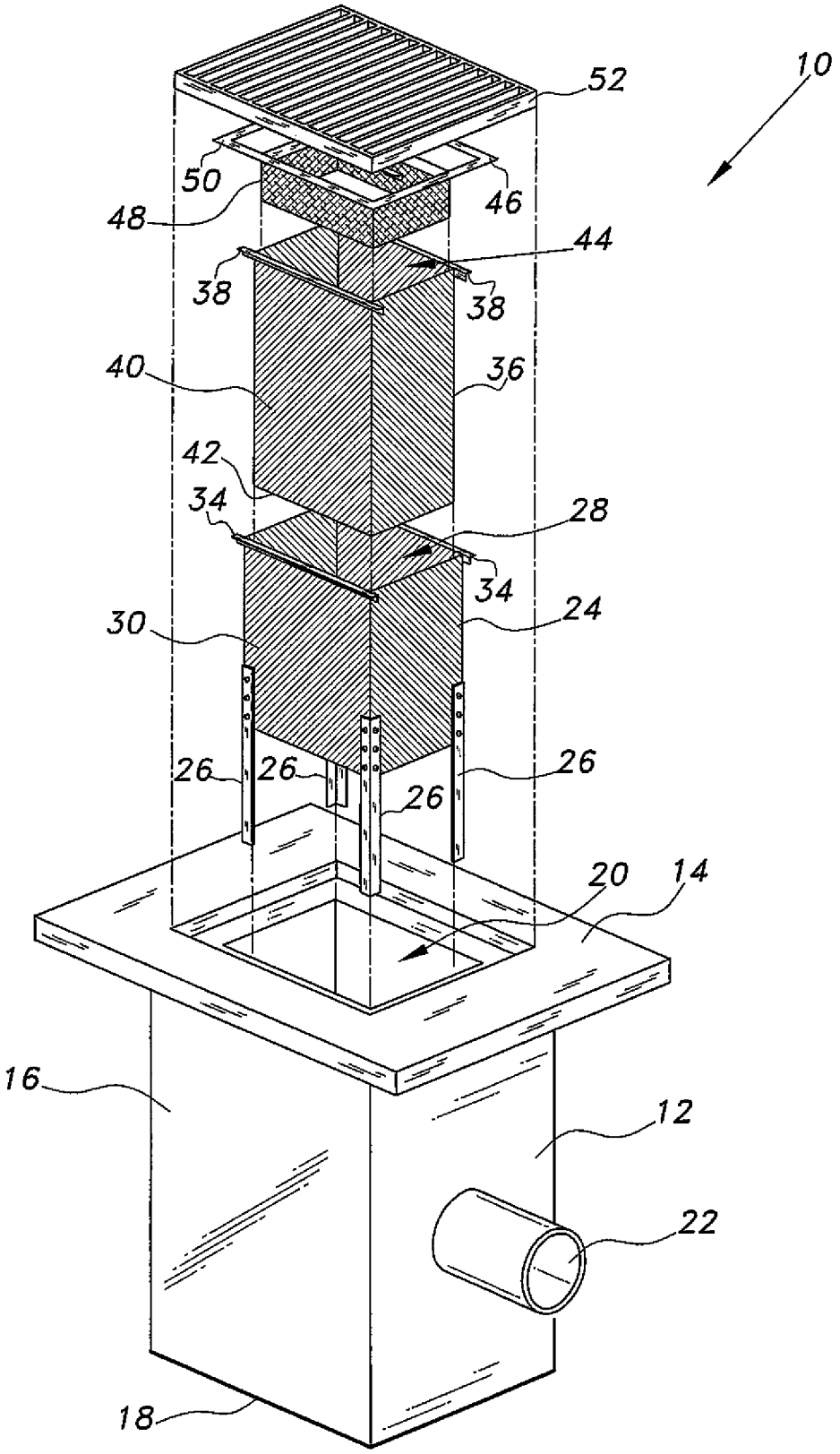
FIG. 2 is an exploded perspective view of the ground water collection system according to the present invention.
Figure 3:
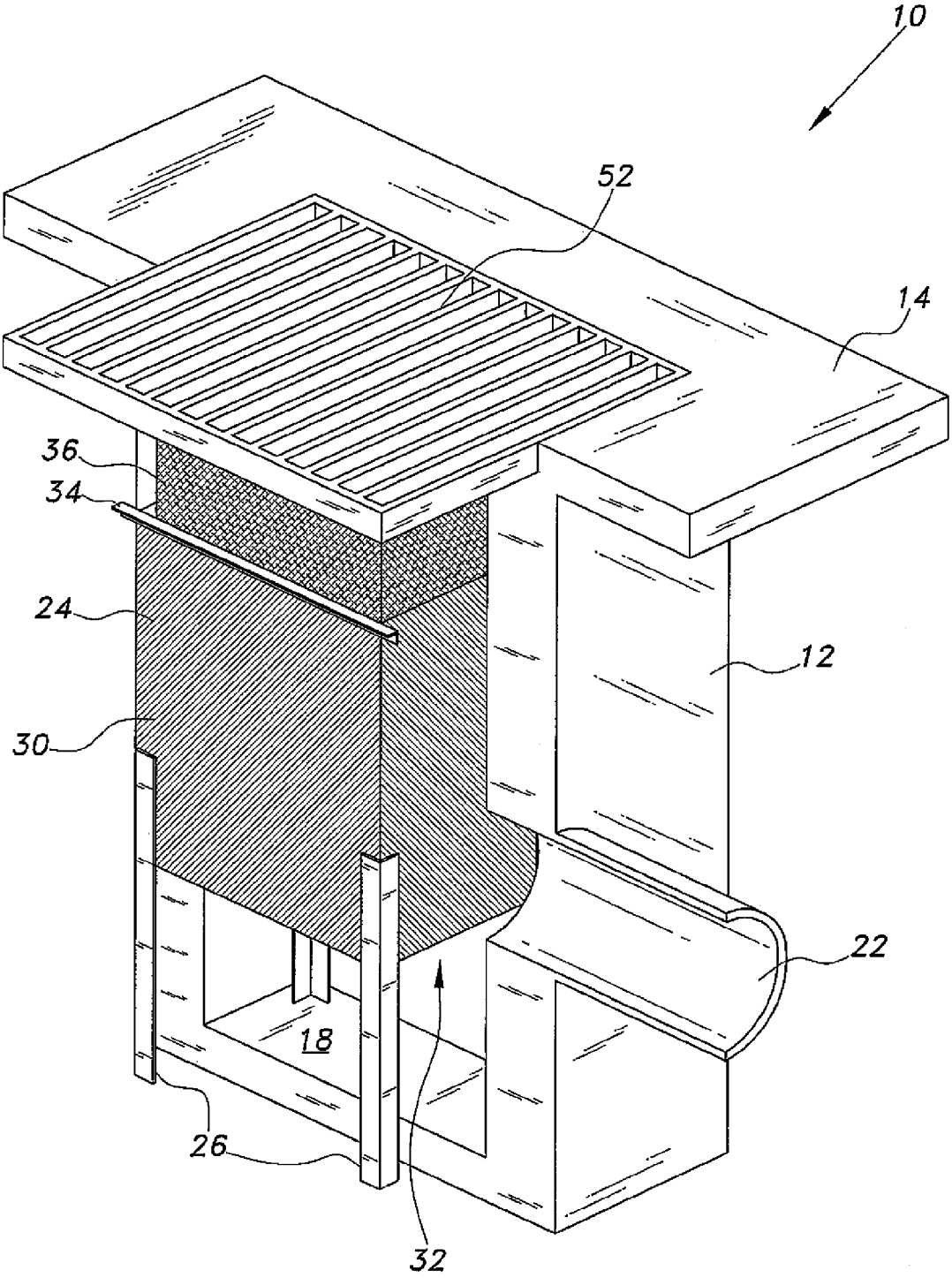
FIG. 3 is a perspective view of the ground water collection system according to the present invention, shown broken away and partially in section.
Figure 5:
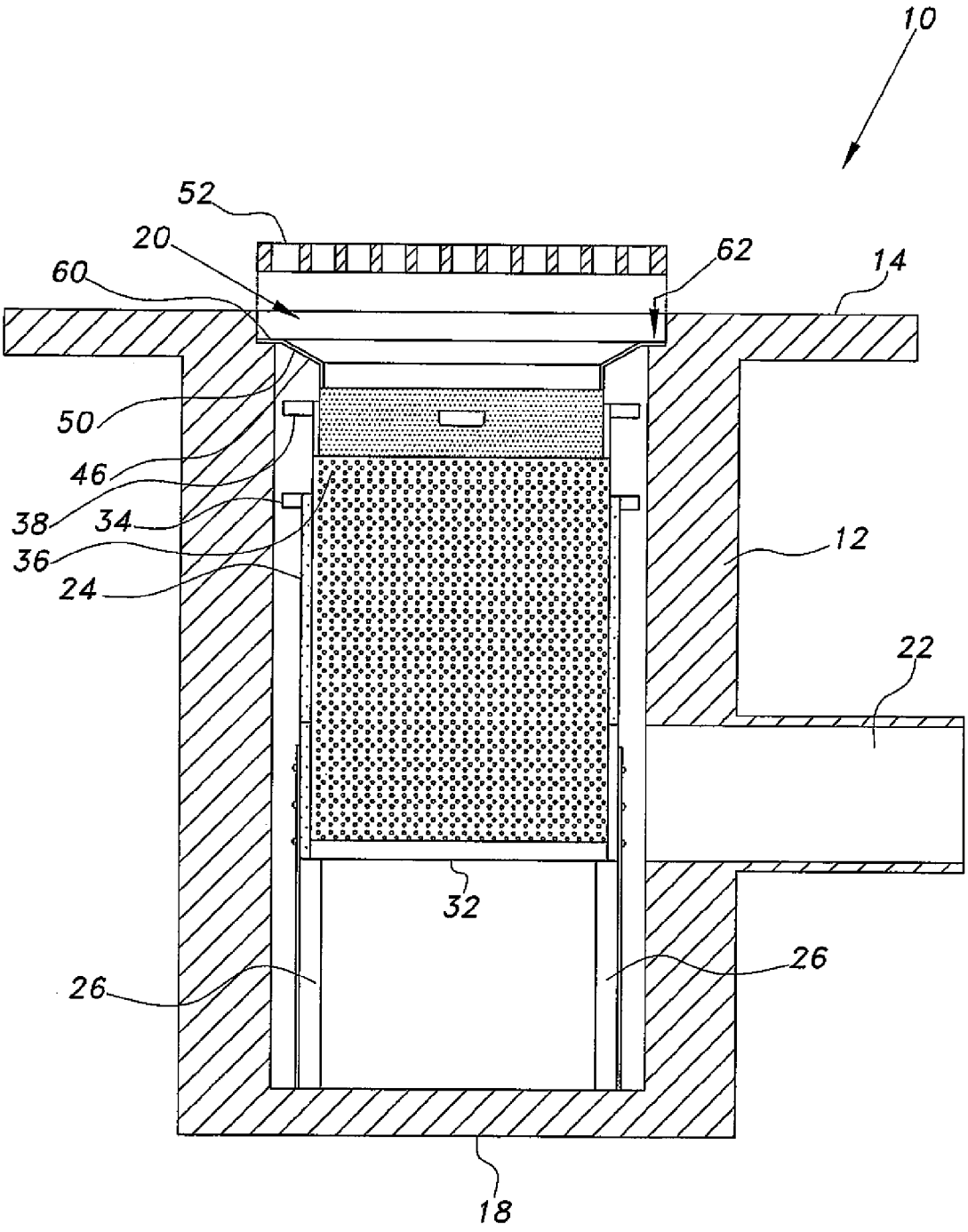
FIG. 5 is a side view in section of the ground water collection system according to the present invention.

As shown in FIGS. 2, 3, and 5, a filter shell 24 is removably inserted within the basin 12, and includes at least one mesh sidewall 30, a solid (i.e., water impermeable) lower wall 32, and an open upper end 28. The filter shell 24 is shown as being substantially rectangular, having four such mesh sidewalls 30. The filter shell 24 preferably is dimensioned and configured so that it may be securely received within the basin 12. As such, the overall dimensions and configuration of the filter shell 24 may vary, depending upon the geometric design of the basin 12.

As shown, a plurality of legs 26 preferably extend from the solid lower wall 32 of the filter shell 24 for positioning the solid lower wall 32 above the closed lower wall 18 of the basin 12 in spaced relation therewith, so that the solid lower wall 32 of the filter shell 24 is positioned adjacent the drainage outlet 12. Additionally, one or more handles 34 may extend from the filter shell 24 adjacent the open upper end 28 thereof for removal of the filter shell 24 from within basin 12. As a further alternative, at least a portion of a bottom end of the at least one mesh sidewall 30 may be reinforced with water impermeable material, but with the region of the at least one mesh sidewall 30 adjacent the drainage outlet 12 remaining unreinforced, thus urging the filtered water toward the drainage outlet 12 and minimizing leakage into the bottom portion of the basin 12.

A filter basket 36 is removably inserted within the filter shell 24, and includes at least one basket sidewall 40, a basket lower wall 42 and an open upper end 44. The at least one basket sidewall 40 and the basket lower wall 42 are each formed from mesh. The filter basket 36 is shown as being substantially rectangular, having four such basket sidewalls 40. The filter basket 36 is preferably dimensioned and configured such that it may be securely received within the filter shell 24. As such, the overall dimensions and configuration of the filter basket 36 may vary, depending upon the geometric design of the basin 12 and the filter shell 24. Additionally, one or more handles 38 may extend from the filter basket 36 adjacent the open upper end 44 thereof for removal of the filter basket 36 from within the filter shell 24.

Figure 4:
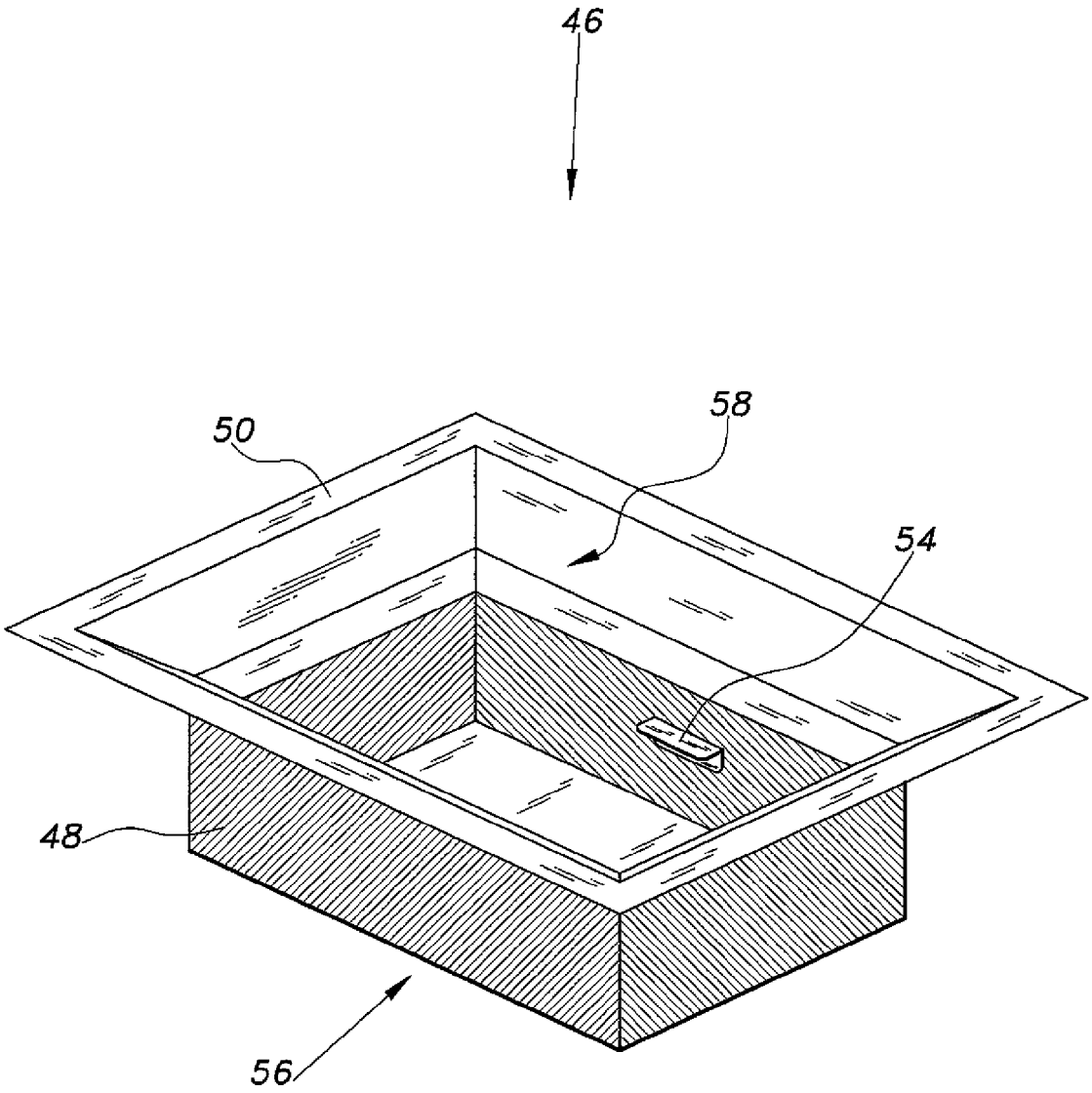
FIG. 4 is a perspective view of a funnel member of the ground water collection system of FIG. 1.

As best shown in FIG. 4, a funnel member 46 is provided and includes at least one funnel sidewall 48 formed from mesh and opposed open lower and upper ends 56, 58, respectively. The funnel member 46 is shown as being substantially rectangular, having four such funnel sidewalls 48. The funnel member 46 preferably is dimensioned and configured such that it may be securely received within the upper end of the filter basket 36 (as shown in FIG. 2). An angled rim 50 is formed about the open upper end 58 of funnel member 46 for funneling the ground water through a central portion of the funnel member and into the filter basket 36. The funnel member 46 is removably inserted within the filter basket 36 such that the at least one funnel sidewall 48 is positioned adjacent the open upper end of the filter basket 36 and the angled rim 50 extends above the basket 36 and is positioned adjacent the open upper end 20 of the basin 12. At least one handle member 54 may extend from the inner face of the at least one funnel sidewall 48, as shown in FIG. 4, for removably lifting the funnel member 46 from the filter basket 36. A grate 52 removably covers the open upper end 20 of the basin 12.

As shown in FIG. 5, a recessed portion 62 may be defined about the open upper end 20 of the basin 12 for receiving the grate 52, so that the grate 52 is positioned flush with the rim 14. Additionally, as shown, the angled rim 50 of funnel member 46 may have a horizontal peripheral flange 60, which rests within the recessed portion 62, so that the grate 52 may sandwich the horizontal peripheral flange 60 against the recessed portion 62, thus releasably securing the funnel member 46 in place.

The at least one mesh sidewall 30 of the filter shell 24 has a first mesh size associated therewith, and the mesh of the filter basket 36 has a second mesh size associated therewith. Preferably, the first mesh size is smaller than the second mesh size. The mesh of the funnel member 46 has a third mesh size associated therewith and, preferably, the third mesh size is equal to the first mesh size. Although any suitable mesh sizes may be used for filtering debris from the ground water, as an example, the first mesh size of the at least one mesh sidewall 30 of the filter shell 24 may be 4 mm, the second mesh size of the filter basket 36 may be 8 mm, and the third mesh size of the funnel member 46 may be 4 mm.

It is to be understood that the present invention is not limited to the embodiments described above, but encompasses any and all embodiments within the scope of the following claims.

I claim:

1. A ground water collection system, comprising:

a filter shell having a mesh sidewall enclosing and defining the filter shell, wherein the entirety of the sidewall has a first mesh size associated therewith, a solid, water impermeable lower wall and an open upper end, the filter shell being adapted for removable reception within a storm basin;

a plurality of legs extending from the solid lower wall of the filter shell for positioning the solid lower wall above a lower wall of the storm basin in spaced relation therewith;

a filter basket, the filter basket being configured and sized to be removably inserted within the filter shell, the filter basket having a mesh sidewall enclosing and defining the filter basket, wherein the entirety of the filter basket sidewall has a second mesh size associated therewith, further wherein the second mesh size is larger than the first mesh size, a basket lower wall and an open upper end; and a funnel member having a mesh funnel sidewall enclosing and defining the funnel member, wherein the entirety of the funnel sidewall has a third mesh size associated therewith, wherein the third mesh size is equal to the first mesh size, opposed open upper and lower ends, and an angled rim formed about the open upper end, the funnel member being configured and sized to be removably inserted within the filter basket so that the funnel sidewall is positioned adjacent the open upper end of the filter basket and the angled rim extends above the filter basket.

2. The ground water collection system as recited in claim 1, wherein said filter shell further comprises at least one shell handle secured thereto adjacent the open upper end thereof.

3. The ground water collection system as recited in claim 2, wherein said filter basket further comprises at least one basket handle secured thereto adjacent the open upper end thereof.

4. The ground water collection system as recited in claim 3, wherein said funnel member further comprises at least one funnel handle secured thereto.

5. The ground water collection system as recited in claim 4, wherein the at least one funnel handle is secured to an inner face of the at least one funnel sidewall.

6. A ground water collection system, comprising:

a basin having at least one sidewall, a closed lower wall and an open upper end, and a drainage outlet formed through the at least one sidewall, the basin being adapted for positioning below ground, the open upper end being positioned at ground level for receiving ground water, the drainage outlet being adapted for communication with a sewer line;

a filter shell having a mesh sidewall enclosing and defining the filter shell, wherein the entirety of the sidewall has a first mesh size associated therewith, a solid, water impermeable lower wall and an open upper end, the filter shell being adapted for removable reception within a storm basin;

a plurality of legs extending from the solid lower wall of the filter shell for positioning the solid lower wall above a lower wall of the storm basin in spaced relation therewith;

a filter basket, the filter basket being configured and sized to be removably inserted within the filter shell, the filter basket having a mesh sidewall enclosing and defining the filter basket, wherein the entirety of the filter basket sidewall has a second mesh size associated therewith, further wherein the second mesh size is larger than the first mesh size, a basket lower wall and an open upper end;

a funnel member having a mesh funnel sidewall enclosing and defining the funnel member, wherein the entirety of the funnel sidewall has a third mesh size associated therewith, wherein the third mesh size is equal to the first mesh size, opposed open upper and lower ends, and an angled rim formed about the open upper end, the funnel member being configured and sized to be removably inserted within the filter basket so that the funnel sidewall is positioned adjacent the open upper end of the filter basket and the angled rim extends above the filter basket; and a grate removably covering the open upper end of the basin.

* * * * *